United States Patent [19]

Lautenschläger, Jr. et al.

[11] 4,210,980

[45] Jul. 8, 1980

[54] CABINET HINGE, ESPECIALLY FOR PERIOD FURNITURE

[75] Inventors: Karl Lautenschläger, Jr.; Horst Lautenschläger; Reinhard Lautenschläger, all of Reinheim, Fed. Rep. of Germany

[73] Assignee: Karl Lautenschlager KG, Mobelbeschlageabrik, Fed. Rep. of Germany

[21] Appl. No.: 959,735

[22] Filed: Nov. 13, 1978

[30] Foreign Application Priority Data

Dec. 24, 1977 [DE] Fed. Rep. of Germany ..... 2758090

[51] Int. Cl.[2] ..... E05D 3/02

[52] U.S. Cl. ..... 16/171; 16/168

[58] Field of Search ..... 16/171, 174, 128, 148, 16/168, 169, 172

[56] References Cited

U.S. PATENT DOCUMENTS

| | | | |
|---|---|---|---|
| 599,251 | 2/1898 | Pitman | 16/174 |
| 814,546 | 3/1906 | Kimple | 16/128 R |
| 1,169,566 | 1/1916 | Prieskorn | 16/128 R |
| 2,837,760 | 6/1958 | Ware | 16/174 |

*Primary Examiner*—Andrew V. Kundrat

[57] ABSTRACT

A hinge for cabinet doors or lids, especially for period furniture, having two visible sleeve-like hinge parts which can be fastened to the supporting wall of the cabinet and to the cabinet door or lid, respectively, and which are swingable relative to one another about the longitudinal axis of a pintle held in one of the hinge parts and engaging a complementary bore in the other hinge part. The pintle is made in one piece with a mounting pin added at approximately right angles to its end held in the hinge part and fastenable in a bore of the associated cabinet part. The visible, sleeve-like hinge part holding the pintle has on the side facing the associated cabinet part an aperture through which the pivot pin can be passed during assembly and from which the mounting pin protrudes. The pintle and the mounting pin are held in the position correctly aligned with the sleeve-like hinge part by a plug pushed onto the mounting pin and plugging up the aperture in the hinge part.

15 Claims, 13 Drawing Figures

CABINET HINGE, ESPECIALLY FOR PERIOD FURNITURE

BACKGROUND

The invention relates to a hinge for cabinet doors or lids, especially for period furniture, having two exposed knuckles, one for fastening to the wall of the cabinet and the other to the door or lid, these parts being able to be swung in relation to one another about the longitudinal central axis of a pintle held in one of the knuckles and engaged in a complementary bore in the other knuckle.

As a result of the changing trends in interior decorating there is an increasing interest in furniture reminiscent of the furniture of earlier periods. Consequently, there is an increasing demand for hinges to harmonize with such furniture, i.e., there is a need for hook-and-eye hinges, or pintle hinges, that is, hinges having exposed knuckles one of which—the one that is fastened to the cabinet wall for example--bears a pintle which is engaged in the other knuckle that is fastened to the cabinet door. The knuckles are additionally provided, as a rule, with decorative finials. The knuckles were formerly, and to some extent still today, produced from sheet steel blanks by rolling. The finials are—or were—made as separate turnings and they were fastened to the rolled knuckles or to a projecting end of the pintle by special procedures. This method of manufacturing such hinges is complicated, even when modern production techniques and machine tools are used, so that hinges suitable for period furniture are relatively expensive despite their simplicity. On the other hand, pintle hinges are also used in modern furniture and on interior doors, in which case the mounting of the members of the hinges is performed as a rule by means of mounting pins projecting from the knuckles at right angles to the hinge axis and bearing a wood screw thread, for example, which is driven into an undersized bore in the door leaf and in the supporting wall or door frame. In such cases it is possible, by varying the depth to which the pin is screwed, to provide for the readjustment of an incorrectly aligned door. However, such adjustment can be made only in steps corresponding at least to the pitch of the thread of the mounting pin, because, for each adjustment, either the member that bears the pintle or the member that is to be engaged by the pintle has to be turned by 360°, or a multiple thereof, since only in this manner will the pintle be in alignment with the bore of the other member of the hinge. Furthermore, the adjustment can be made only with the door removed.

THE INVENTION

The object of the invention is to simplify the manufacture of the pintle hinge and hence to reduce its cost, without involving functional or esthetic disadvantages. Furthermore, a stepless adjustment of the hung door must be possible on at least one of the hinge members.

Setting out from hinges of the initially mentioned kind, this object is solved in accordance with the invention in that the pintle is manufactured in one piece with a pin extending approximately at a right angle to its axis, which can be fastened in a bore in the associated cabinet part, that the exposed knuckle holding the pintle has on the side facing the associated cabinet part an aperture through which the pintle can be passed during assembly and from which the mounting pin will project, and that the pintle and the mounting pin integral therewith are held in correct alignment with the knuckle by a plug which is placed over the mounting pin and plugs the aperture in the knuckle. With regard to the knuckle that bears the pintle, therefore, high stability is achieved by making both the pintle and the mounting pin in one piece, since these pins, which are invisible in the assembled hinge, and which are important for the load-bearing function and life of the hinge, are of simple form and can be manufactured without difficulty from a metal of sufficient strength, preferably steel. The mounting pin can be set in the bore in the corresponding part of the cabinet in a known manner, e.g., by means of a cotter or split pin passing through a cross bore in the end portion of the mounting pin. Alternatively, the mounting pin can also be provided with a wood screw thread whereby it can be driven into the undersized bore provided in the cabinet body. The knuckle, which determines the decorative appearance of the assembled hinge, is relieved of stress by the one-piece combined pintle and mounting pin, and does not itself need to be fastened to the cabinet. Therefore, the mounting flaps attached to the knuckles in the old-style hinges made from sheet steel are eliminated.

In a preferred embodiment of the invention, the pintles and mounting pins are two sections of an originally straight piece of found steel rod bent at right angles to one another. The starting material of the integral pintle-and-pin combination is therefore bright-drawn round steel rod, which is merely bent to the angular shape. The free end of the pintle—and also of the mounting pin of desired--can also be chamfered for the purpose of facilitating introduction into the corresponding bore. Further operations on them, however, are unnecessary.

The knuckle itself can advantageously be made in the form of a metal die casting, the use of zinc alloy (Zamak) being preferred. Manufacturing the knuckles as metal die also permits the production of more highly ornate parts without the need for chasing. The fact that such die castings are not as strong as steel can be accepted, since there is no great stress on the hinge, as previously pointed out.

The plug which holds the pintle and mounting pin in the knuckle is preferably made of injection molded plastic and fits tightly in the complementary aperture in the knuckle.

In the hinge of the invention, the knuckle in which the pintle is mounted has, as a rule, an elongated profile on its exposed front side, while its top surface, or the surface confronting the other knuckle, is flat. In such hinges, the construction, in further development of the invention, is preferably such that the pintle is held in an elongated cavity within the knuckle, which has an aperture at the flat surface for the emergence of the pintle, and an elongated, slot-like aperture at the back of the knuckle confronting the furniture piece, the width of the slot-like aperture being slightly greater than the diameter of the pintle, and its length being such and the aperture in the flat surface being so shaped that the pintle can be introduced through the back aperture into the cavity and made to protrude from the aperture in the flat surface. If the pintle is shorter than the length of the back aperture, the installation of the pintle in the knuckle presents no difficulty. If, however, the pintle is longer than the knuckle, the back aperture must be cut back in the area of its bottom end such that the pintle can be introduced in a slanting position. At the same time, the hole or aperture from which the installed pintle protrudes must be slightly enlarged in the direction toward which the pintle is inclined during installation.

The desired stepless adjustability is accomplished, in further development of the invention, on the second knuckle into which the pintle is to be inserted, by providing a slide block which is attached to this knuckle at right angles to the hinge pivot axis and which is disposed for longitudinal displacement in an insert piece which can be fastened in a complementary mortise in the cabinet door or lid, and by providing a threaded spindle engaging the slide block on the one hand and the insert piece on the other, which upon rotation produces a stepless, positive displacement of these two components relative to one another.

The threaded spindle is preferably disposed in a bore whose one side is in the slide block and the other in the insert, the one side of the bore being provided with a female thread corresponding to the thread on the threaded spindle, while the other side has a web at right angles to the axis of the spindle, which engages an annular groove turned in the spindle. The spindle, therefore, is held so that it is non-displaceable axially with respect to the side of the bore that contains the web, while relative longitudinal displacement with respect to the threaded side is possible.

Preferably, the bore side containing the female thread is formed in the slide block and the side provided with the web is formed in the insert.

For the sake of simplicity and economy it is recommendable to make the insert of injection molded plastic. Alternatively, it can be a metal die casting. The guide boock, however, is preferably a metal die casting made integral with the second knuckle.

The invention is further explained in the following description of an embodiment in conjunction with the drawing, wherein.

Figure 1:
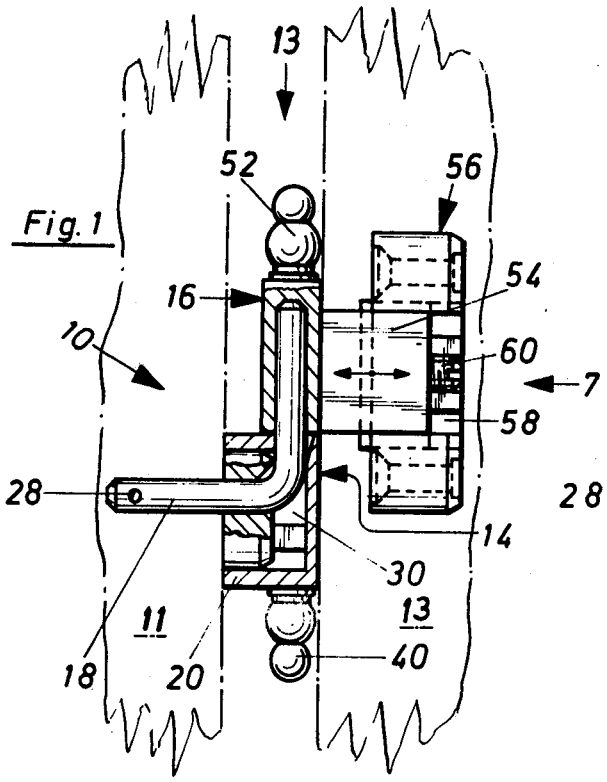
FIG. 1 is a side elevational view, partially in cross section, of a hinge of the invention.
Figure 2:
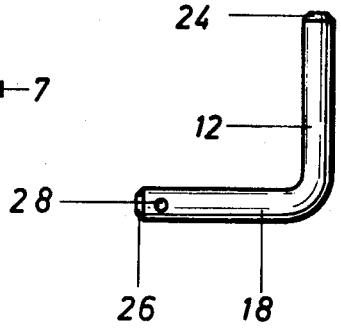
FIG. 2 is a side elevational view of the integral pintle and fastening pin of the hinge of FIG. 1.

The hinge of the invention, which is shown in FIG. 1 where it is identified as a whole by the number 10, consists of the first hinge half 14 bearing the the pintle 12 and the second hinge half 16 which pivots on the pintle. The hinge half 14 is composed virtually of three parts, namely the previously mentioned pintle 12 which is integral with a mounting pin 18 bent at right angles from its lower end (FIG. 2), a knuckle 20 (FIGS. 5 and 6) visible when hinge 10 is completely assembled, and a plug 22 (FIGS. 3 and 4) holding the pintle and fastening pin in the knuckle 20.

The component formed by the pintle 12 and the fastening pin 18 integral therewith is bent from a piece of bright-drawn round steel of appropriate length, and the free ends of the pintle 12 and fastening pin 18 are chamfered at 24 and 26 to facilitate introduction into the corresponding bores in hinge half 16 and in the corresponding cabinet wall. A transverse bore 28 in the outer end area of the fastening pin 18 serves for the fixation of the fastening pin in the cabinet wall by means of a cotter or split pin. Alternatively, the fastening pin can also be provided with a coarse, sharp-edged thread, so that it can be screwed into the undersized bore in the corresponding cabinet wall.

Figure 6:
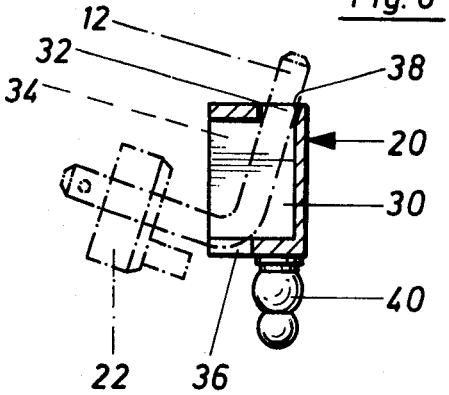
FIG. 6 is a cross-sectional view of the knuckle shown in FIG. 5, seen in the direction of the arrows 6—6, the method of assembly of the pintle being illustrated in broken lines.

The pintle 12 is mounted in the knuckle 20 in the manner represented in FIG. 6. For this purpose the knuckle 20 has a cavity 30 into which the lower portion of the pintle 12 can be fitted and having at its upper end a hole 32 through which the outer end of the pintle can emerge. On the side of the knuckle facing the cabinet wall the cavity 30 has an elongated aperture 34 through which the pintle is introduced. The width of this aperture is s lightly larger than the diameter of the pintle. The length of the aperture 34 and its shape at the lower end is such as to permit the introduction of the pintle at an angle as indicated in dash-dotted lines. In the case illustrated, in which the pintle 12 is longer than the aperture 34, the bottom edge of the aperture is cut back at 36. Also, the hole 32 is chamfered at 38 to accommodate the slantingly introduced pivot pin. Otherwise, the hole 32 is of a cylindrical shape fitted to the diameter of the pivot pin 12. It is apparent that the cutaway at 36 and the chamfer at 38 can be eliminated if the total length of the pivot pin is slightly shorter than the length of the aperture 34, since the pivot pin then does not have to be angled as it is introduced into the aperture and passed through the hole 32.

The first knuckle 20 is made of pressure-cast metal, preferably of a zinc die casting alloy, the decorative finial 40 being die-cast integral therewith. Alternatively, this finial 40 can also be a separately made piece having a threaded or unthreaded stud to be driven into a corresponding bore (not shown) in the hinge part 20. This last-named embodiment has the advantage that differently styled finials can be fastened to the same knuckle.

Figure 3:
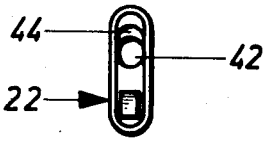
FIG. 3 is a front elevational view of the plug holding the pintle and fastening pin in the exposed knuckle.
Figure 4:
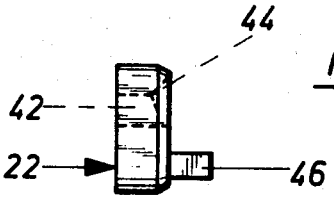
FIG. 4 is a side elevational view of the plug shown in FIG. 3.
Figure 5:
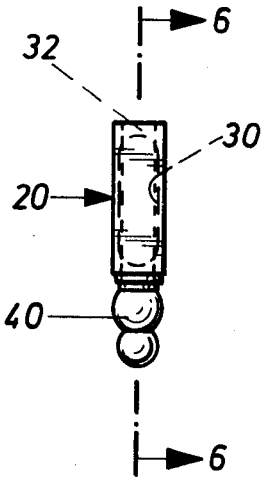
FIG. 5 is a front elevational view of the first knuckle of the hinge of the invention represented in FIG. 1.

The fastening of the pintle 12 and of the mounting pin 18 combined with it in the correct position in the knuckle 20 is accomplished by means of the plug 22 shown in FIGS. 3 and 4, which is made by injection molding from plastic, and whose external shape matches the aperture 34, a tight fitting of the plug 22 in the aperture 34 being used for the purpose of assuring that the pintle 12 will not become loose in the knuckle 20. The mounting pin 18 is passed through a hole 42 of circular cross section in the plug 22 and held in place, this hole 42 being chamfered at 44 at its inside upper end so as to accommodate the bend between the mounting pin and the pintle.

The projection 46 on the lower part of the inner side of the plug 22 is made of a size corresponding to the cavity 30 and serves as a stop to prevent the plug from being driven too far into the aperture 34.

Figure 9:
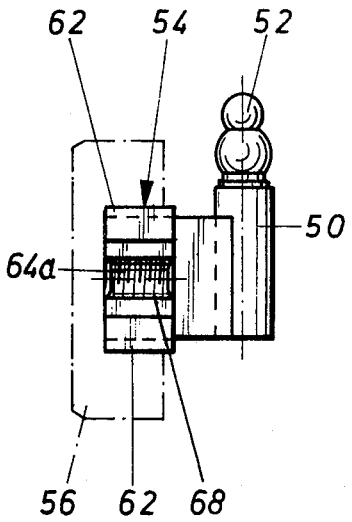
FIG. 9 is a view of the second knuckle as well as a guiding piece made in one piece therewith, seen in the direction represented by the arrow 9 in FIG. 7.
Figure 7:
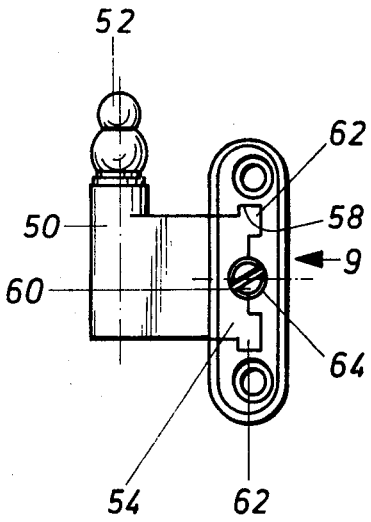
FIG. 7 is a view of the second knuckle which is to be engaged by the pintle, seen in the direction of the arrow 7 in FIG. 1.
Figure 8:
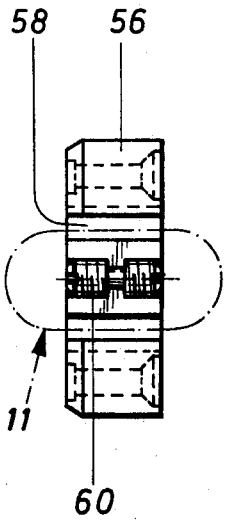
FIG. 8 is a side elevational view of an insert piece which can be fastened in the cabinet door or lid, and in which the second knuckle is displaceably mounted at right angles to the hinge pivot axis.
Figure 10:
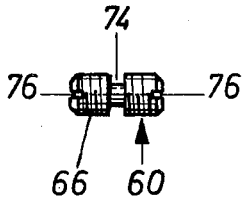
FIG. 10 is a view of the threaded spindle which is in engagement with the slide block and produces its relative longitudinal displacement.
Figure 11:
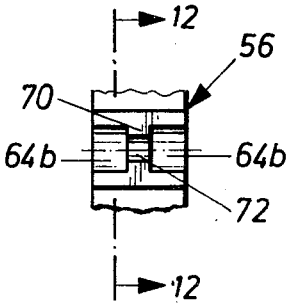
FIG. 11 is a partial view of the area of the insert piece within the dash-dotted oval 11 in FIG. 8, the threaded pin represented in FIG. 8 being omitted.
Figure 12:
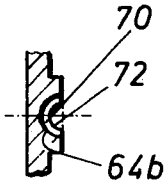
FIG. 12 is a cross-sectional view seen in the direction of the arrows 12—12 in FIG. 11.

The hinge half 16 is likewise composed of three parts, namely the knuckle 50 mounted on the pintle 12 (FIGS. 7 and 9), having a finial 52 matching the finial 40, and a slide block 54 projecting at right angles to the hinge pivot axis, an insert piece 56 which can be fastened in a mortise in the edge of a cabinet door or lid (FIGS. 7 and 8) and has a slot 58 of a cross section matching that of the slide block 54, in which the slide block can be inserted and in which it is held in a longitudinally displaceable manner, and a threaded spindle 60 engaging the slide block 54 on the one hand and the insert piece 56 on the other (FIGS. 7, 8 and 10).

The cross-sectional shape of the slide block 54 and the complementary cross-sectional shape of the slot 56 can be seen especially in FIGS. 7 and 9. The elongated, prismatic slide block 54 is situated in the open-ended slot 58 and has along its upper and lower longitudinal edges the inwardly offset prismatic guides 62 which are mated with groove-like portions of the slot 58, so that the slide block 54 is displaceable only longitudinally in the insert piece 56 and can be inserted into it or removed from it only from the ends of the insert.

A bore 64 provided approximately on the longitudinal central axis of the slide block at the seam between the slide block and the bottom surface of the slot 58 is situated such that one side **64*a* (FIG. 9) is in the slide block 54 and the other side 64*b* in the bottom surface of the slot 58 in the insert 56. The bore side 64*a* is provided with a female thread 68 complementary to the thread 66 of the threaded spindle 60, while the other side 64*b* is smooth over most of its length and has a radius which is slightly larger than the outer radius of the thread 66 of threaded spindle 60, measured at the crest of the threads. A web 70 rises approximately centrally from the bore side 64*b* and has a semicircular recess 72 in its center, whose radius is slightly larger than the radius of the threaded spindle measured to the crest of the threads. Then, in the center of the threaded spindle 60 there is turned a groove 74 which is engaged by the web 70, i.e., the spindle 60 is held rotatably but against longitudinal displacement in the bore side 64*b*, while it is in threaded engagement with the bore side 64*a*. When the threaded spindle 60 is turned with a screwdriver inserted into one of its slots 76, the slide block 54 will be moved in or out of the insert piece 56, depending on the direction in which the spindle is turned, and the displacement of the slide block relative to the insert piece can be steplessly varied by turning the spindle to any desired angle. The pitch of the male thread 66 and of the female thread 68 is selected so as to provide a degree of binding such that no separate antirotational means needs to be provided for the threaded spindle 60**.

Figure 13:
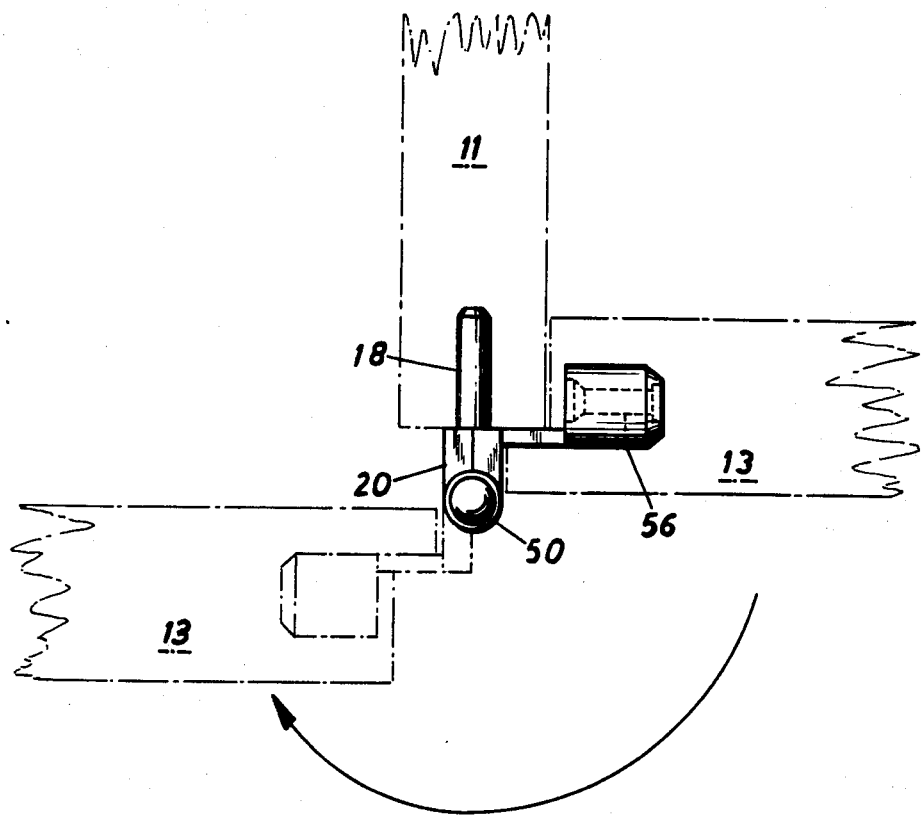
FIG. 13 is a top view of the hinge according to the invention, as seen in the direction of the arrow 13 in FIG. 1, and showing the closed and completely open position of the hinge.

FIG. 13 is a top view of the hinge 10 showing two positions, namely the completely closed and the completely opened position of the hinge. FIG. 13 also shows in dot-dash lines the furniture wall 11 carrying the first hinge portion 14 and the door 13 carrying the second hinge portion 16.

We claim:

1. A hinge for cabinet doors or lids, especially for period furniture, comprising: two visible, sleeve-like hinge parts to be fastened to the supporting wall of the cabinet and to the cabinet door or lid, respectively, a pintle held in one of the hinge parts and engaging a complementary bore in the other hinge part, said hinge parts being swingable relative to one another about the longitudinal axis of said pintle, a mounting pin integral with said pintle and added at approximately right angles to its end held in the hinge part and fastenable in a bore of the associated cabinet part, said visible, sleeve-like hinge part holding the pintle having on the side facing the associated cabinet part an aperture through which the mounting pin can be passed during assembly and from which the mounting pin protrudes, and a plug holding said pintle and said mounting pin in the position correctly aligned with the sleeve-like hinge part, said plug being pushed onto the mounting pin and plugging up the aperture in the hinge part.

2. A hinge according to claim 1, wherein said pintle and said mounting pin form two sections, bent to a right angle position to one another, of an originally straight piece of round steel rod.

3. A hinge according to claim 1, wherein the sleeve-like hinge part is a metal die casting.

4. A hinge according to claim 3, wherein said hinge part is a zinc die casting (Zamak).

5. A hinge according to any one of claims 1 to 4, wherein said plug is a plastic injection molding inserted with a tight fit into the complementary aperture in the sleevelike hinge part.

6. A hinge according to any one of claims 1 to 4, in which the hinge part holding the pintle has an elongated shape rounded on its visible face, while the surface facing the other hinge part which receives the pintle is flat, said pintle being held in an elongated cavity which has a hole at the flat surface for the pintle, and whose surface facing the front side of the section of the pintle which is held in the hinge part fittedly surrounds the pintle, and which at the back merges into the aperture opening toward the furniture part, which has the form of an elongated slot whose width is slightly larger than the diameter of the pintle, the aperture being of such length and the hole for the protruding free and of the pintle being so shaped that the pintle can be introduced through the aperture into the cavity and can protrude from the hole.

7. A hinge according to any one of claims 1 to 4, wherein the second hinge part receiving the pintle has a slide block set at right angles to the hinge pivot axis, an insert longitudinally displaceably receiving said slide block, said insert being adapted to be fastened in a complementary mortise in the cabinet door or lid, and a threaded spindle engaging the slide block and the insert, said spindle when turned bringing about a positive, stepless displacement of the slide block relative to the insert.

8. A hinge according to claim 6, wherein the second hinge part receiving the pintle has a slide block set at right angles to the hinge pivot axis, an insert longitudinally displaceably receiving said slide block, said insert being adapted to be fastened in a complementary mortise in the cabinet door or lid, and a threaded spindle engaging the slide block and the insert, said spindle when turned bringing about a positive, stepless displacement of the slide block relative to the insert.

9. A hinge according to claim 7, wherein said threaded spindle is disposed in a bore formed half in the slide block and half in the insert and having a thread, the one half of the bore being provided with a female thread complementary to the thread of the threaded spindle, a web in the other half and projecting at right angles to the longitudinal axis of the threaded spindle, and an annular groove in the threaded spindle and engaged by said web.

10. A hinge according to claim 8, wherein said threaded spindle is disposed in a bore formed half in the slide block and half in the insert and having a thread, the one half of the bore being provided with a female thread complementary to the thread of the threaded spindle, a web in the other half and projecting at right angles to the longitudinal axis of the threaded spindle, and an annular groove in the threaded spindle and engaged by said web.

11. A hinge according to claim 9, wherein the half of the bore in the slide block bearing the female thread and the half provided with the web is formed in the insert.

12. A hinge according to claim 10, wherein the half of the bore in the slide block bearing the female thread and the half provided with the web is formed in the insert.

13. A hinge according to claim 8, wherein said insert is injection molded of plastic.

14. A hinge according to claim 8, wherein said insert is a metal die casting.

15. A hinge according to claim 8, wherein said slide block is a metal die casting made in one piece with the second hinge part.

* * * * *